US009359981B1

(12) United States Patent
Waisanen et al.

(10) Patent No.: US 9,359,981 B1
(45) Date of Patent: Jun. 7, 2016

(54) OUTBOARD MOTOR WITH SOUND ENHANCEMENT DEVICE AND METHOD FOR MODIFYING SOUNDS PRODUCED BY AIR INTAKE SYSTEM OF AN OUTBOARD MOTOR

(71) Applicant: Brunswick Corporation, Lake Forest, IL (US)

(72) Inventors: Andrew S. Waisanen, Fond du Lac, WI (US); Jeffrey C. Etapa, Elkhart Lake, WI (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 14/707,229

(22) Filed: May 8, 2015

(51) Int. Cl.

| | |
|---|---|
| ***F02M 35/12*** | (2006.01) |
| ***F02M 35/16*** | (2006.01) |
| ***F02B 61/04*** | (2006.01) |
| ***B63H 20/32*** | (2006.01) |

(52) U.S. Cl.
CPC ..... *F02M 35/125* (2013.01); *B63H 20/32* (2013.01); *F02B 61/045* (2013.01); *F02M 35/167* (2013.01)

(58) Field of Classification Search
CPC ..... F02M 35/12
USPC ..... 181/229
See application file for complete search history.

(56) References Cited

U.S. PATENT DOCUMENTS

| | | | | |
|---|---|---|---|---|
| 4,522,602 | A * | 6/1985 | Okazaki | 440/77 |
| 4,734,070 | A * | 3/1988 | Mondek | 440/88 R |
| 4,778,029 | A * | 10/1988 | Thornburgh | 181/229 |
| 4,846,300 | A | 7/1989 | Boda | |
| 5,083,538 | A | 1/1992 | Hubbell | |
| 6,647,956 | B1 | 11/2003 | Sharpton | |
| 6,722,467 | B1 | 4/2004 | Kusche et al. | |
| 6,830,024 | B2 | 12/2004 | Kodweiss et al. | |
| 7,188,703 | B2 * | 3/2007 | Hofmann et al. | 181/271 |
| 7,299,783 | B1 | 11/2007 | Broman et al. | |
| 7,845,466 | B2 * | 12/2010 | Kostun et al. | 181/271 |
| RE42,490 | E * | 6/2011 | Takeuchi et al. | 181/271 |
| 8,011,469 | B2 * | 9/2011 | Olson | 181/204 |
| 8,384,528 | B2 | 2/2013 | McCarthy et al. | |
| 8,651,906 | B1 * | 2/2014 | Morton | 440/77 |
| 8,684,132 | B2 * | 4/2014 | Muller et al. | 181/229 |
| 8,776,755 | B2 | 7/2014 | Muller et al. | |
| 2005/0121255 | A1 * | 6/2005 | Hofmann et al. | 181/250 |
| 2005/0133300 | A1 * | 6/2005 | Hofmann et al. | 181/250 |
| 2007/0054569 | A1 * | 3/2007 | Murai et al. | 440/77 |
| 2009/0078497 | A1 * | 3/2009 | Ishizuka et al. | 181/229 |
| 2011/0147116 | A1 | 6/2011 | Olson | |
| 2014/0055258 | A1 | 2/2014 | Grosse-Budde | |

OTHER PUBLICATIONS

K.C. Colwell, Faking It: Engine-Sound Enhancement Explained, Car and Driver Website, Apr. 2012, available at http://www.caranddriver.com/features/faking-it-engine-sound-enhancement-explained-tech-dept, 7 pages.

* cited by examiner

*Primary Examiner* — Forrest M Phillips
(74) *Attorney, Agent, or Firm* — Andrus Intellectual Property Law, LLP

(57) ABSTRACT

An outboard motor including a system for enhancement of a first subset of sounds having a desired frequency, and a method for modifying sounds produced by an air intake system for an internal combustion engine powering the outboard motor are described. The method includes collecting sounds emitted in an area proximate a throttle body of the engine. A first subset of the collected sounds, which have frequencies within desired frequency range, are then amplified. The amplified first subset of sounds are then transmitted to an area outside a cowl covering the engine.

20 Claims, 5 Drawing Sheets

OUTBOARD MOTOR WITH SOUND ENHANCEMENT DEVICE AND METHOD FOR MODIFYING SOUNDS PRODUCED BY AIR INTAKE SYSTEM OF AN OUTBOARD MOTOR

FIELD

The present disclosure relates to air intake systems for internal combustion engines associated with outboard motor propulsion systems.

BACKGROUND

U.S. Pat. No. 4,846,300, hereby incorporated by reference, discloses a marine engine with a multi-section injection-molded thermoplastic air box directing air to the fuel system's air intake throat and silencing engine noise emitted back through the throat. The air box has a cover section and a base section mounted to each other solely by a seal along a peripheral seam around the entire perimeter thereof, to prevent fuel leaks. The housing sections are preassembled to each other prior to mounting to the air intake throat. A removeable plug in the cover section allows access through the cover section to bolts mounting the base section to the throat. Access is also enabled to a fuel adjustment screw to enable adjustment, with the air box fully assembled and mounted in place on the throat, to enable adjustment under actual operating conditions. Air guide passages and an air plenum chamber are all molded in place.

U.S. Pat. No. 5,083,538, hereby incorporated by reference, discloses an air intake system for an internal combustion engine associated with the power head of an outboard marine propulsion system. The engine includes a vertical crank shaft and a flywheel mounted to the crank shaft above the engine block. An air manifold is mounted to the forward side of the engine, and includes an air inlet for receiving intake air. The air intake system includes an air flow path or duct defined by a series of walls, a rearwardly facing air intake opening, and a discharge opening for supplying intake air to the air manifold inlet. The engine is enclosed within a cowl assembly, and the air intake opening is located toward the upper end of the cowl assembly interior. The walls defining the air flow duct are formed integrally with a flywheel cover for facilitating assembly of the air flow duct to the engine. The air flow duct minimizes ingestion of water into the engine and reduces engine noise in the boat.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

One example of the present disclosure includes a method for modifying sounds produced by an air intake system for an internal combustion engine powering an outboard motor. The method includes collecting sounds emitted in an area proximate a throttle body of the engine. A first subset of the collected sounds, which have frequencies within a desired frequency range, are then amplified. The amplified first subset of sounds are transmitted to an area outside a cowl covering the engine.

According to another example of the present disclosure, an outboard motor includes an internal combustion engine powering the outboard motor and a cowl covering the internal combustion engine. An air vent allows intake air into the cowl, and a throttle body meters flow of intake air to the engine. A duct is provided having an inlet end located proximate the throttle body and an outlet end located proximate an outer surface of the cowl. A sound enhancement device is located within the duct between the inlet end and the outlet end. The sound enhancement device is tuned to amplify a first subset of sounds collected via the inlet end of the duct. The first subset of sounds have a desired frequency. The amplified first subset of sounds are transmitted to an area outside the cowl via the outlet end of the duct.

BRIEF DESCRIPTION OF THE DRAWINGS

The present disclosure is described with reference to the following Figures. The same numbers are used throughout the Figures to reference like features and like components.

DETAILED DESCRIPTION

In the present description, certain terms have been used for brevity, clarity and understanding. No unnecessary limitations are to be inferred therefrom beyond the requirement of the prior art because such terms are used for descriptive purposes only and are intended to be broadly construed.

Figure 1:
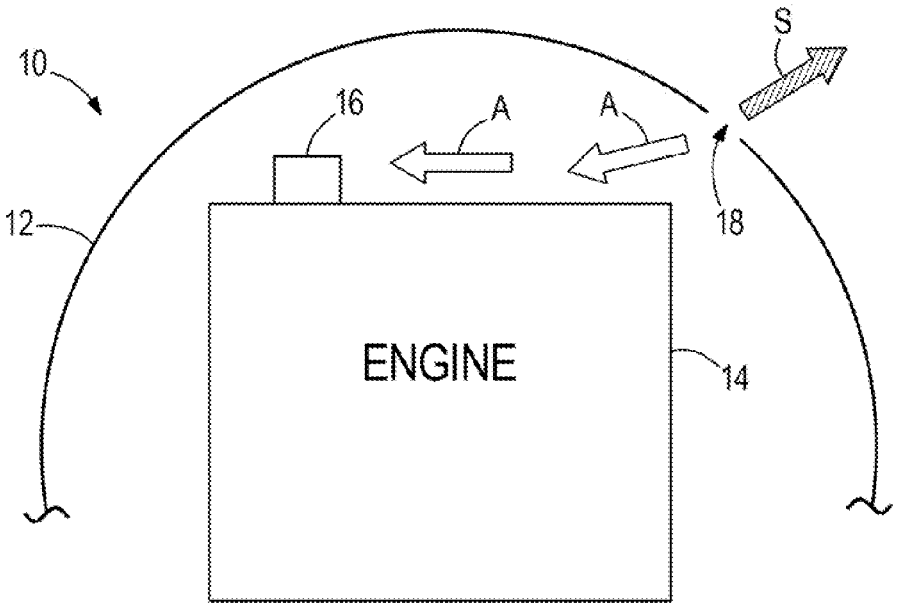
FIG. 1 PRIOR ART
FIG. 1 illustrates one example of a prior art outboard motor air intake system.

FIG. 1 is a simplified schematic illustrating a prior art outboard motor 10 including an upper cowl 12 covering an internal combustion engine 14. As is known, the internal combustion engine 14 powers a propeller of the outboard motor 10, via a series of connections and gears that couple a crankshaft of the engine 14 to a propeller shaft. A throttle valve located in throttle body 16 meters intake of air into the engine's cylinders, where the air is mixed with fuel and ignited in order to drive the engine's pistons, which movement causes the crankshaft to rotate. Air is provided to the interior of the cowl 12 through an air vent 18, which is shown as a simple hole extending through the cowl 12. However, it should be understood that the air vent 18 can have a flap or shield provided over or around it in order to prevent rain or water from entering the cowl 12.

In the system shown in FIG. 1, air enters through the air vent 18 and, as shown by the arrows labeled "A," flows toward the throttle body 16, where it then flows past the throttle valve and into the engine 14. The throttle valve can be either electronically or manually actuated. Sound produced by the engine 14, including sound produced by the air intake system (for example due to flow of air past the throttle valve in the throttle body 16) leaves the cowl 12 of the outboard motor 10 through the same vent 18, as shown by the arrow labeled "S." Mechanical noise from the engine 14 is also transmitted out of this vent 18, which is often located on the aft end or the side of the cowl 12 in order to transmit the noise away from the operator of the marine vessel to which the outboard motor 10 is coupled. In certain outboard motors, the air intake system is provided with a silencer that attenuates the noise produced by the air intake system, such as described in U.S. Pat. Nos. 4,846,300 and 5,083,538, incorporated herein above. Other components, such as an intake duct that acts as a resonator, may be attached to the vent 18 and/or throttle body 16. The design of such a resonator is typically optimized to balance tradeoffs between performance of the engine 14, packaging of the engine 14 and its components within the cowl 12, and noise vibration and hardness (NVH) characteristics.

However, product noise requirements and/or expectations of a given outboard motor can vary greatly depending on the application. For example, performance and/or bass boaters may desire a louder, more powerful sound quality than would an off-shore fisherman or recreational boater. However, expectations for sound quality and refinement are universal, and dictated in some geographical areas by law, regardless of the noise level expectations of the customer. The system and method of the present disclosure, shown in FIGS. 2-5 below, enhance the powerful, desirable sound characteristics of an outboard engine without sacrificing the requirements and/or expectations for refinement of unpleasant sound.

Figure 2:
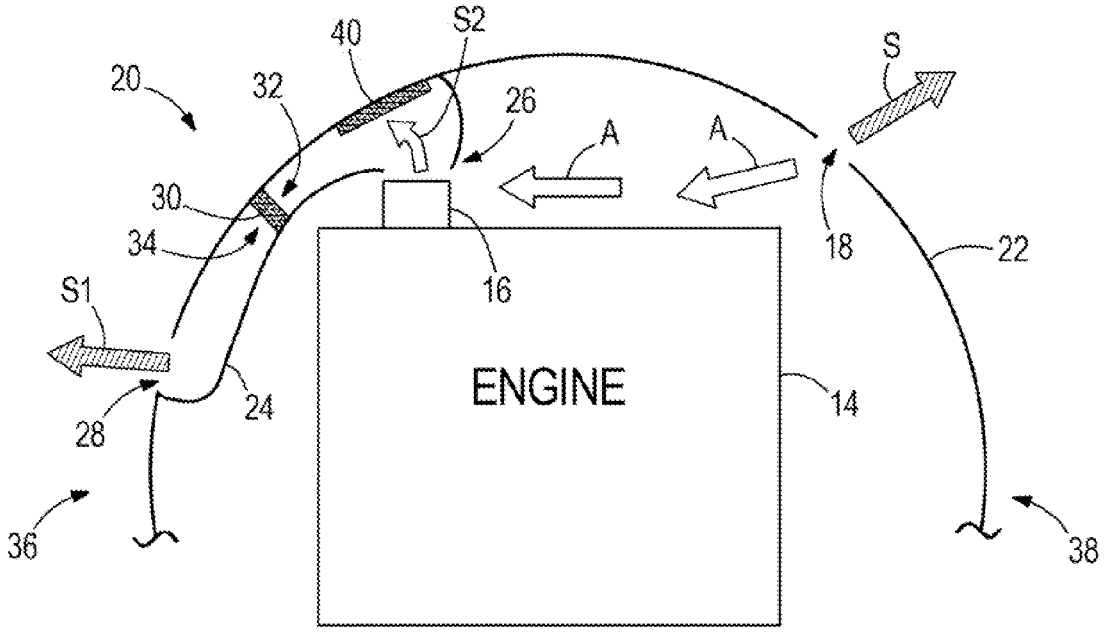
FIG. 2 illustrates one example of an outboard motor air intake system according the present disclosure.

A simplified schematic of an outboard motor 20 according to the present disclosure is shown in FIG. 2. Similar to the outboard motor 10 shown in FIG. 1, the outboard motor 20 includes a cowl 22; however, the cowl 22 has been modified as will be described further herein below. The cowl 22 covers an engine 14, which has a throttle body 16 metering air intake to the engine 14. Similar to the outboard motor 10 of FIG. 1, the outboard motor 20 of FIG. 2 has an air vent 18 that allows intake air to flow into the interior of the cowl 22, as shown by the arrows labeled "A" and that allows sound to escape from the vent 18, as shown by the arrow "S." Unlike the prior art motor, the present outboard motor 20 fiurther includes a sound enhancement duct 24 having an inlet end 26 located proximate the throttle body 16 and an outlet end 28 located proximate an outer surface of the cowl 22. The inlet end 26 collects sounds that are emitted from the throttle body 16. However, the inlet end 26 is not physically connected to the throttle body 16. Rather, in the example shown, the inlet end 26 of the duct 24 is located adjacent to, but does not touch, the throttle body 16. Thus, the sound enhancement duct 24 is not a functional part of the air induction system and does not supply air to the engine 14, nor does it convey any engine exhaust. The inlet end 26 of the duct 24 is positioned at a particularly chosen distance away from the throttle body 16, such that emitted sounds can be collected, but also such that the cowl 22 of the outboard motor 20 can be removed without needing to disconnect the duct 24 from the throttle body 16. The duct 24 can be made of PVC, the same material as the cowl 22, or another material that is suitable for an under-cowl environment. The duct 24 can have a cross-sectional shape of a circle, an oval, a rectangle, or another type of polygon, according to the desired sound effect and the shape of the cowl in which it is located.

A sound enhancement device 30 is located within the duct 24 between the inlet end 26 and the outlet end 28. Sounds that are collected at the inlet end 26 are routed through the duct 24 to the sound enhancement device 30, which is tuned to amplify a first subset of sounds that have been collected from the area proximate the throttle body 16. In this way, the sound enhancement device 30 acts as a passive speaker that is tuned to amplify the first subset of sounds. The sound enhancement device 30 adjusts the spectral frequency (sound amplitude vs. frequency) of the first subset of sounds without the use of active components such as, for example, electronic amplifiers. This first subset of sounds can be defined in any way desired by the manufacturer. For example, the first subset of sounds may be sounds that have frequencies within a desired frequency range. For example, the desired sounds may be those in the frequency range that produce what might be considered a pleasant "rumble" that conveys the power of the engine 14 to the operator of the vessel. The sound enhancement device 30 can be tuned to amplify this pleasant rumble such that the operator can hear it better.

In one example, the sound enhancement device 30 comprises a flexible membrane that extends generally transversely across the interior of the duct 24. The membrane can have any sort of shape that will fill the cross-sectional shape of the duct 24, and its outer edges can be sealed along an inner perimeter of the duct 24 so as to isolate an interior of the duct 24 on a first side 32 of the membrane from air flow in the interior of the duct 24 on a second, opposite side 34 of the membrane. The membrane may be made out of any sort of flexible or elastomeric substance, and in one example is a disc made out of rubber. A stiffness of the membrane can be tuned in order to provide a desired amount of amplification of the first subset of sounds (the desirable sounds). The stiffness of the membrane can be varied by stretching the membrane tighter or allowing the membrane to be looser as it spans the cross-sectional area of the duct 24. Another way in which the acoustic flexure properties of the membrane may be tuned or adjusted is by varying the thickness (and therefore mass and stiffness) of the membrane. Additionally, the composition of the membrane itself and/or products that are applied to the membrane can cause it to exhibit different characteristics upon application of sound waves. Because the sound enhancement system (including duct 24 and sound enhancement device 30) is passive, it relies on acoustic excitation of the sound enhancement device 30 by sounds radiating from the throttle body 16 to provide amplification. In alternative embodiments, the sound enhancement device is a membrane made of plastic or of a thin metal sheet. The sound enhancement device may also take forms other than that of a membrane, such as a trumpet.

The outlet end 28 of the duct 24 is located proximate an outer surface of the cowl 22, so as to deliver the amplified first subset of sounds to the area outside of the cowl 22. In the example shown in FIG. 2, the outlet end 28 ends flush with the cowl 22. Further, in the example shown, the outlet end 28 of the duct 24 is positioned at a fore side 36 of the outboard motor. In contrast, the air vent 18 is positioned at the aft side 38 of the outboard motor 20. As mentioned above, this allows unpleasant mechanical or air intake noises to exit the cowl 22 remote from the operator. The amplified pleasant sounds exit the cowl 22 closer to the operator.

More specifically, as shown in FIG. 2, the air vent 18 that allows intake air into the cowl 22 is located aft of the throttle body 16, and a majority of the duct 24 is located fore of the throttle body 16. Thus, the outlet end 28 of the duct 24 is located fore of the throttle body 16 as well. This ensures that the first subset of sounds (shown by the arrow labeled "S1") that have been collected and amplified by their passage through the duct 24 and by the sound enhancement device 30, are directed toward the operator of the outboard motor, as they are emitted from the fore side 36 of the outboard motor 20. Meanwhile, the sounds "S" that are not in the subset "S1" (i.e., sounds that do not have the desired frequency) are emitted via the vent 18, which, because it is located on the aft side 38 of the outboard motor, directs the undesired sounds away from the operator. Thus, the operator can better hear the amplified, desirable sounds than he or she can hear the non-amplified remainder of the sounds.

The duct 24 may be coupled to an inner surface of the cowl 22 as shown here, and as will be further described herein below. This allows the cowl 22 to be removed from the remainder of the outboard motor 10 (for example, from a lower cowl portion) in order to service the engine 14, without needing to make sure the duct 24 is detached from the cowl 22, or that the duct 24 is detached from the throttle body 16, beforehand. In other words, because the duct 24 is coupled to the cowl 22, the duct 24 is easily removed with the cowl 22. Further, as described above, because the duct 24 is not coupled to the throttle body 16, there is no need to make sure that these two parts are disconnected prior to removing the cowl 22.

Several different characteristics, structures, and designs for the duct 24 and the location of the sound enhancement device 30 are available. In one example, the inlet end 26 of the duct 24 is positioned precisely at a selected distance from the throttle body 16 so as to provide a desired amount of amplification of the first subset of sounds S1. Additionally, the position of the sound enhancement device 30 within the duct 24 can be selected specifically so as to provide a desired amount of amplification of the first subset of sounds S1. The shape and diameter of the duct 24 can also be selected specifically to achieve the desired enhancement of sound.

The outboard motor 20 shown in FIG. 2 can also be designed to attenuate a second subset of the sounds that are collected at the inlet end 26 of the duct 24. This second subset of collected sounds may have frequencies that are within an undesired frequency range. For example, these may be sounds having a frequency that might be considered annoying to the operator of the outboard motor 20. In order to attenuate the second subset of sounds, the length and/or shape of the duct 24 can be selected specifically to provide a desired amount of attenuation. Alternatively or additionally, a stiffness of the membrane of the sound enhancement device 30 can be tuned to provide a desired amount of attenuation of the second subset of sounds. Additionally or alternatively, a sound dampening device 40 may be provided within the duct 24 so as to provide a desired amount of attenuation of the second subset of sounds (see arrow labeled "S2"). The sound dampening device 40 could be a small fibrous pad, another type of padded material, or a similar spongey-type material that is designed to attenuate certain frequencies of sounds. The sound dampening device 40 can be provided on an inner surface of the duct 24, or can cross the duct 24 in a transverse manner, similar to the sound enhancement device 30. Additionally or alternatively, a duct leading from the air vent 18 and located upstream of the throttle body 16, acting as or providing a connection to a resonator, could be used to attenuate sounds created by the flow of intake air. Therefore, the system provides enhancement of desirable engine sound characteristics, while minimizing unwanted sounds that radiate from cowl openings. By suppressing unwanted sounds and highlighting desirable sounds, a more refined sound quality can be obtained.

Now turning to FIGS. 3 and 4, another example of a cowl 42 for an outboard motor will be described. In this example, the air vent that allows intake air into the cowl 42 is provided on a lateral side (or both lateral sides) of the cowl 42. For example, see vent 44 shown on the starboard side of the cowl 42 in FIG. 3. As shown by the arrows in FIG. 4, air flows through this vent 44, and then through an air intake duct 45 that is formed integrally on the undersurface of the cowl 42 to an opening 46, where the air then enters the under-cowl environment 47. Any water that accidentally enters through the vent 44 collects in the lowest area of the intake duct 45 (which lowest area is shown at arrow 48), and drains out of the water drain 50 provided through the exterior surface of the cowl 42 (see FIG. 3). After the intake air has entered the under-cowl environment 47, the air then flows upward as shown by the arrows in FIG. 4 to the throttle body 16, through which it then enters the engine 14.

Figure 3:
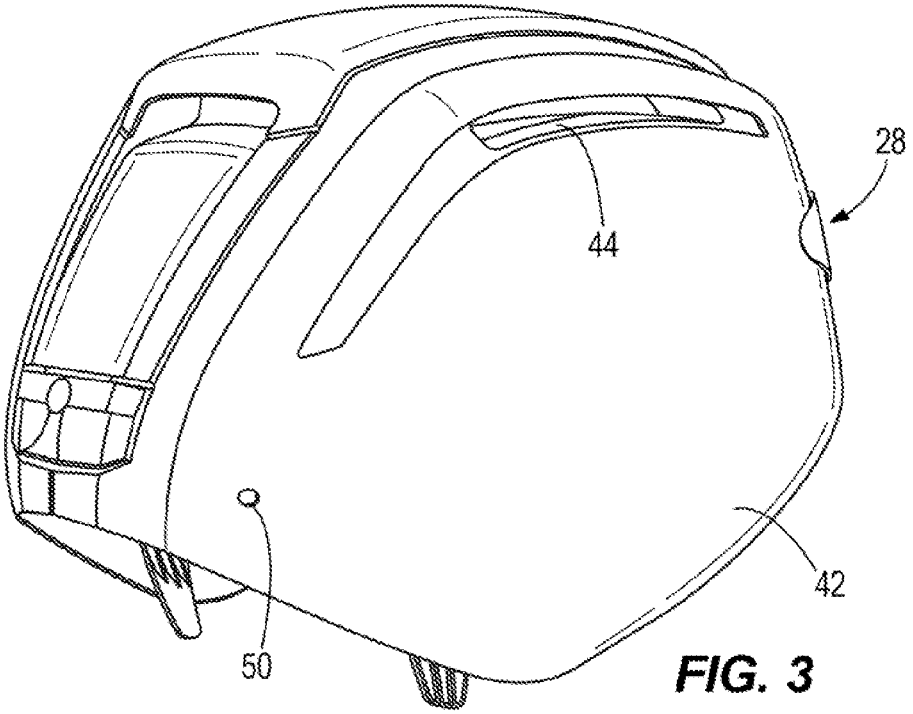
FIG. 3 illustrates a cowl of another example of an outboard motor air intake system according to the present disclosure.
Figure 4:
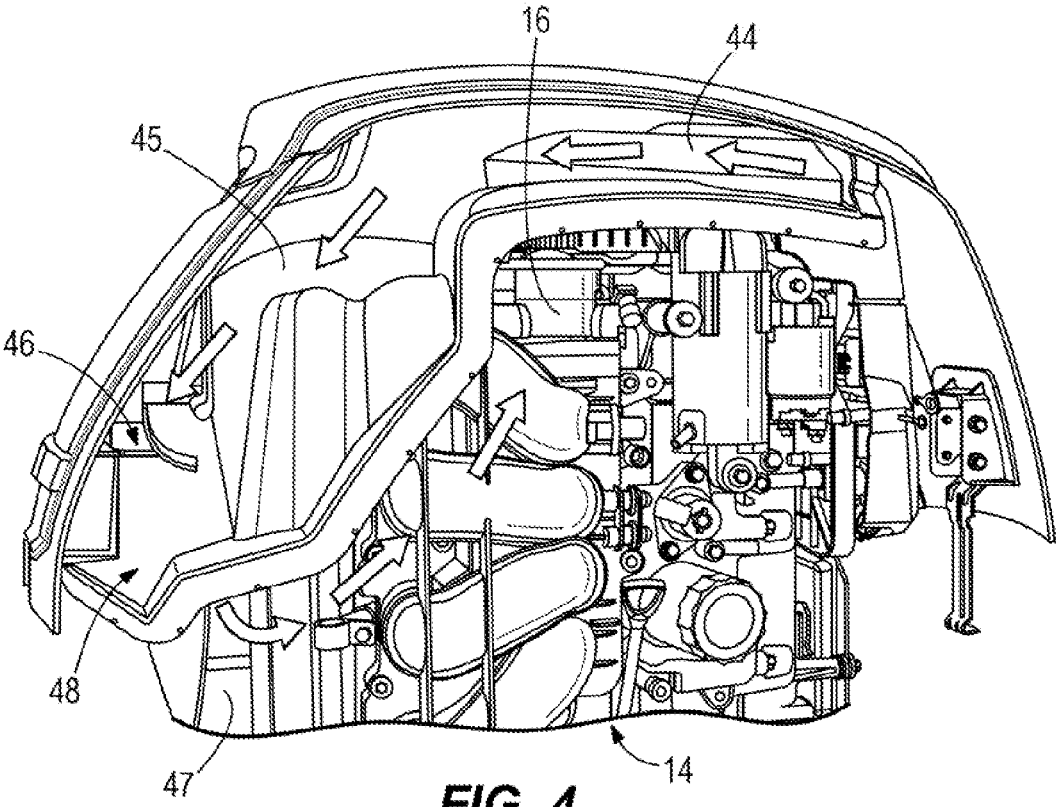
FIG. 4 illustrates a view of an engine covered by a portion of the outboard motor cowl of FIG. 3.
Figure 5:
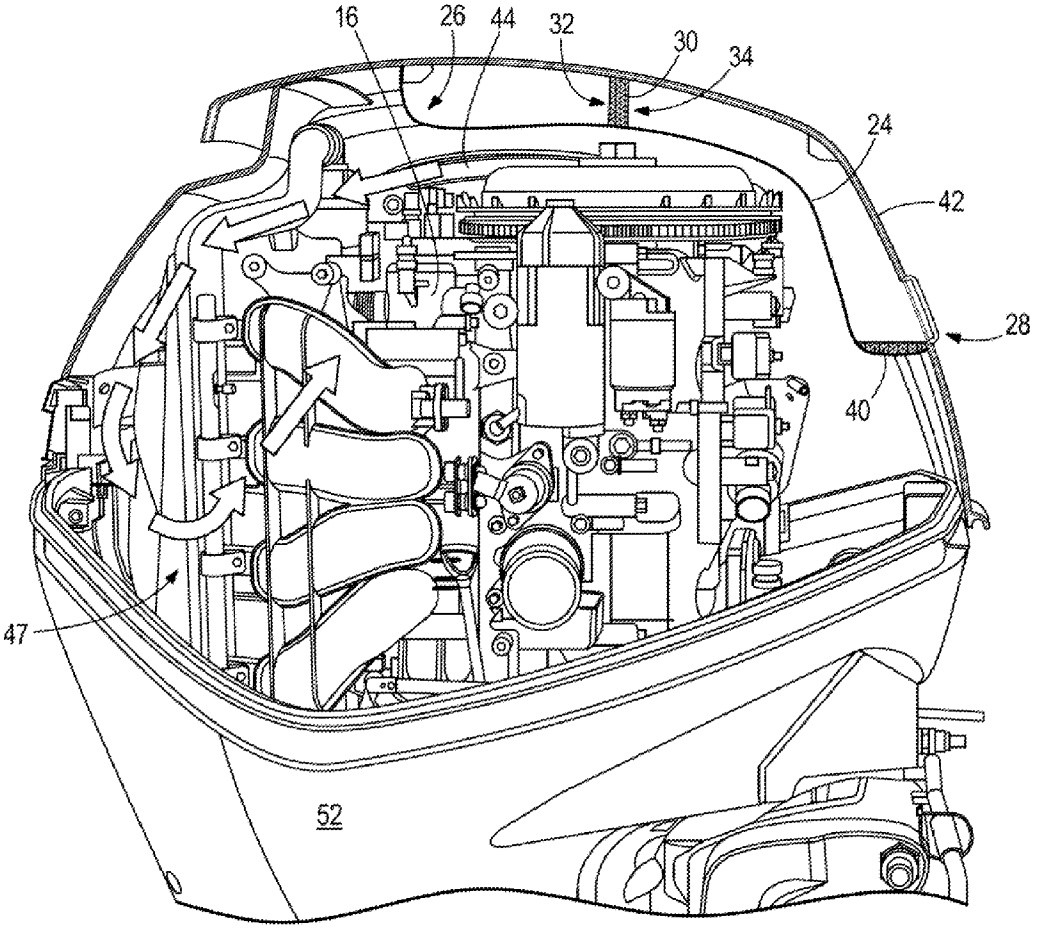
FIG. 5 illustrates a view of the engine of FIG. 4, with even more of the cowl removed.

FIG. 5 shows the engine and cowl 42 of FIGS. 3 and 4. However, in this view, the structure of the air intake duct 45 has been removed in order to show the sound enhancement duct 24 located to port of the air intake duct 45. The pathway that the air follows through the air intake duct 45 is still shown by the upper three arrows in FIG. 5. The lower two arrows then show the upward flow of air once it has entered the under-cowl environment 47, as it makes its way toward the throttle body 16. FIG. 5 also shows how the cowl 42 may in fact be an upper cowl portion, and how it is separable from a lower cowl portion 52 of the outboard motor.

FIG. 5 shows a duct 24 and sound enhancement device 30, similar to those shown in FIG. 2. FIG. 5 also shows how the shape of the duct 24, placement of the sound enhancement device 30, and placement of the sound dampening device 40 can be varied to provide a different amount of amplification or attenuation of different frequencies of sounds. FIG. 5 also shows how the outlet end 28 of the duct may extend slightly through an outer surface of the cowl 42. (See also FIG. 3.) The outlet end 28 can be styled similar to the vent 44, and can be provided with a grill, grate, flap, or similar device to prevent intake of water, and/or such that it appears stylistically the same as other vents in the cowl structure.

The sound enhancement duct 24 in both FIGS. 2 and 5 can be coupled to, or even integrally molded with, the undersurface of the cowl. The duct 24 diverts noise radiated from the throttle body 16 to a specified location exterior of the cowl 22, 42. A sound enhancement device 30 such as a tunable membrane is provided inside the duct 24 to amplify a desired frequency of sound. The sound enhancement device 30 can be tuned, for example, via its stiffness properties to transmit desired frequencies of interest, while the duct 24 and sound enhancement device 30 together can be shaped and/or tuned to isolate or attenuate undesired frequencies of annoyance. Because the duct 24 is not attached directly to the intake system (or to throttle body 16), but instead positioned in close proximity to the throttle body (for example, within four inches), the cowl 22, 42 can be removed from the remainder of the outboard without needing to disconnect the sound enhancement system from other components of the engine 14. Water is also isolated from the under-cowl environment 47 due to the sound enhancement device 30, because air on the first side 32 of the sound enhancement device 30 is isolated from air (and other fluid flow) on its second side 34, which is in fluid communication with the atmosphere surrounding the cowl 22, 42. Therefore, water intrusion is not a design compromise that needs to be made when selecting the location of the outlet end 28 of the duct 24.

Figure 6:
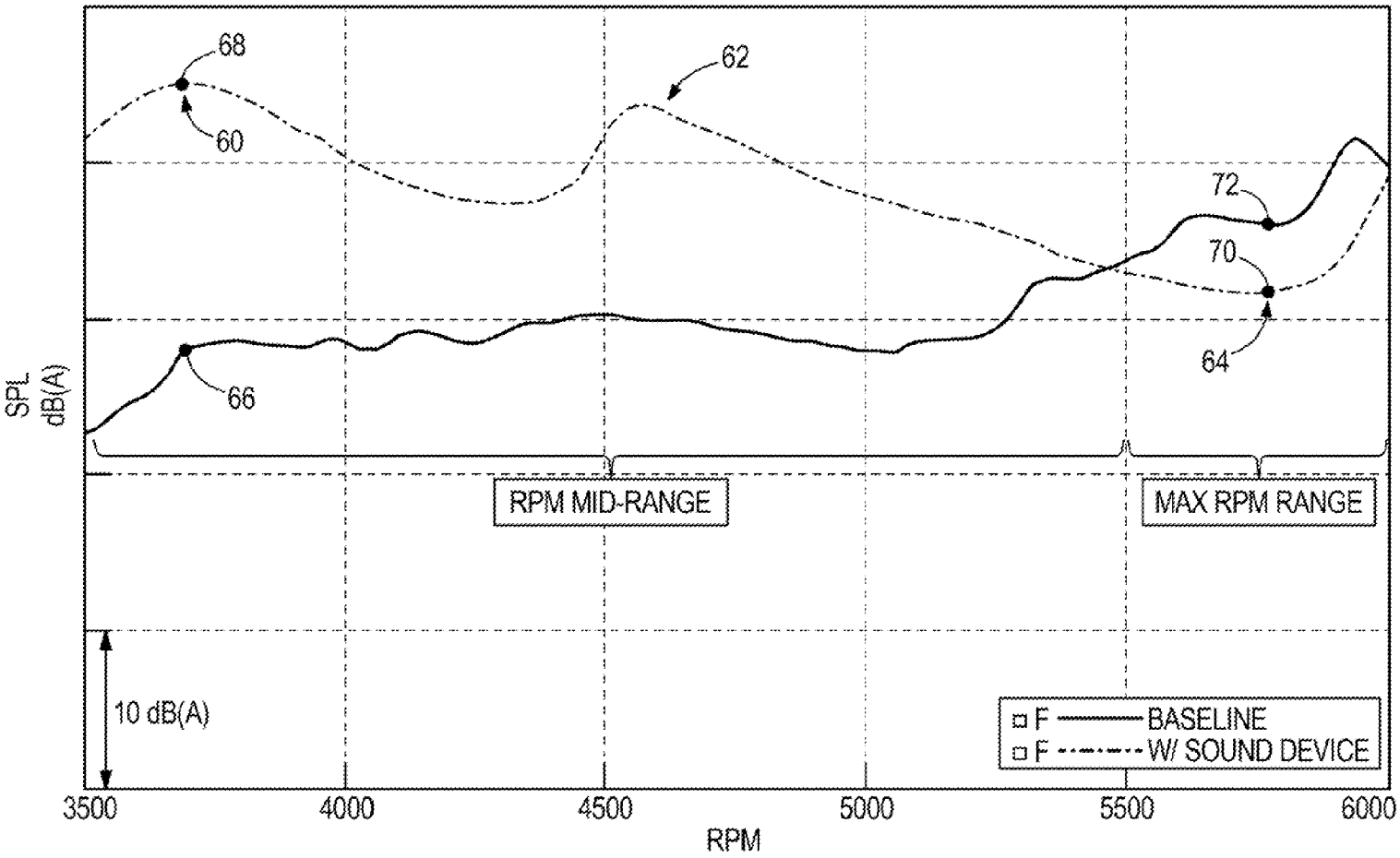
FIG. 6 is a graph illustrating one example of a result of amplifying air intake sounds produced by an engine operating at mid-range speeds.

Now turning to FIG. 6, one example of the result of using the sound enhancement system of the present disclosure will be described. FIG. 6 is a graph illustrating an exemplary sound pressure level (SPL) in A-weighted decibels dB(A) versus an engine speed in RPM. Baseline noise produced by the engine at various engine speeds is shown by the solid line curve, while noises produced while using a sound device according to the present disclosure are shown by the curve in dashed lines. In this example, speeds from about 3500 RPM to about 5500 RPM constitute the engine's mid-range, while speeds between about 5500 RPM and 6000 RPM constitute the maximum RPM range. It should be noted that each of the sound pressure levels shown by the curves are the sound pressure levels produced by each of the baseline case and the sound-enhanced case individually, and that a plot showing the net SPL result would more likely be a summation of the sound pressure levels shown by each individual curve. However, the curves are shown separately in order to display the amplification provided by the sound enhancement system of the present disclosure.

At the area labeled 60, amplification of the SPL over the baseline case due to contribution of the sound enhancement device 30, such as a tunable membrane, is shown. Here, about 14-16 decibels of amplification are provided in the range of approximately 3700 RPM to 3800 RPM. (For example, compare the baseline case at point 66 with the sound-enhanced case at point 68, showing an SPL difference of about 16 dB(A).) The contribution of the sound enhancement device 30 continues for speeds above 3800 RPM, but gradually drops off as speeds increase. Eventually, when the engine reaches higher speeds of approximately 4500 RPM to 4600 RPM, the geometry of the duct 24 instead contributes to amplification of the sounds, as shown at area 62. Contribution to amplification provided by the duct 24 also drops off as engine speeds increase, until as shown at area 64, the sound pressure level is no longer amplified with respect to the baseline case due to the length of the duct 24, which creates an acoustic node at the end of the duct 24 when speeds approach approximately 5700 RPM to 5800 RPM. Compare point 70 with point 72. Nonetheless, in reality, because noise is radiated through both the cowl itself and the sound enhancement duct 24, the operator still perceives the baseline sound in this speed range, because as described above it is additive to the sound produced by the sound enhancement system. The test sound enhancement system shown in this plot was optimized to provide increased sound pressure level at mid-range engine speeds for improved hole-shot sound quality, without sacrificing SPL at maximum RPM. Other systems could be designed to provide different amounts of amplification and/or amplification of different frequencies of sounds (e.g. sounds produced at engine speeds other than those shown here).

Now turning to FIG. 7, a method according to the present disclosure for modifying sounds produced by an air intake system for an internal combustion engine 14 powering an outboard motor 20 will be described. As shown at box 702, the method includes collecting sounds emitted in an area proximate an engine throttle body 16. As shown at 704, the method includes amplifying a first subset S1 of the collected sounds having frequencies within a desired frequency range. As shown at 706, the method includes transmitting the amplified first subset of sounds S1 to an area outside a cowl 22, 42 covering the engine 14. As shown at box 708, the method may also include attenuating a second subset S2 of the collected sounds. This second subset S2 may include sounds having frequencies that are within an undesired frequency range.

Figure 7:
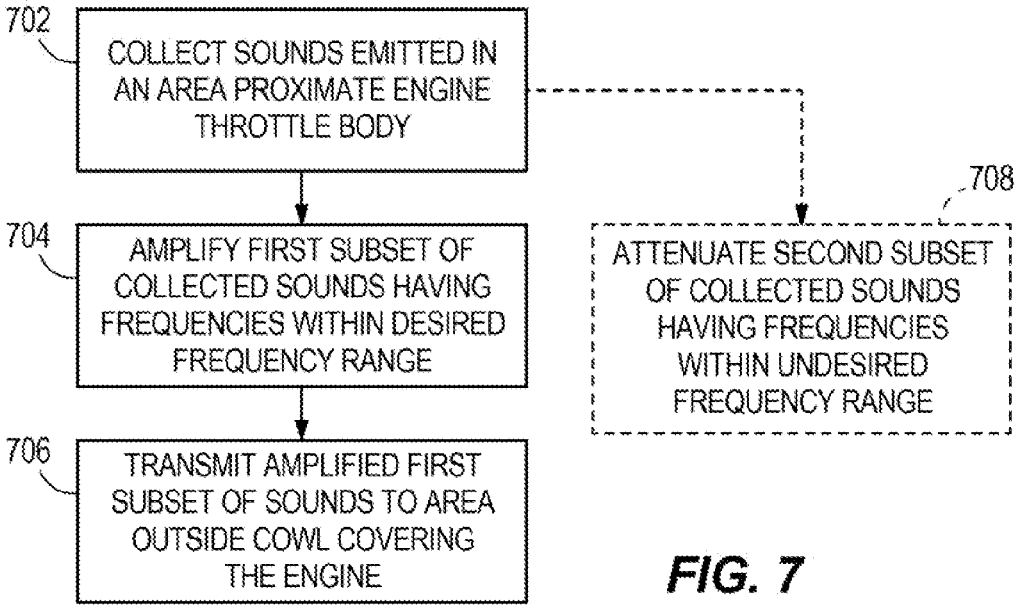
FIG. 7 illustrates one example of a method for modifying sounds produced by an air intake system for an internal combustion engine powering an outboard motor.
Figure 8:
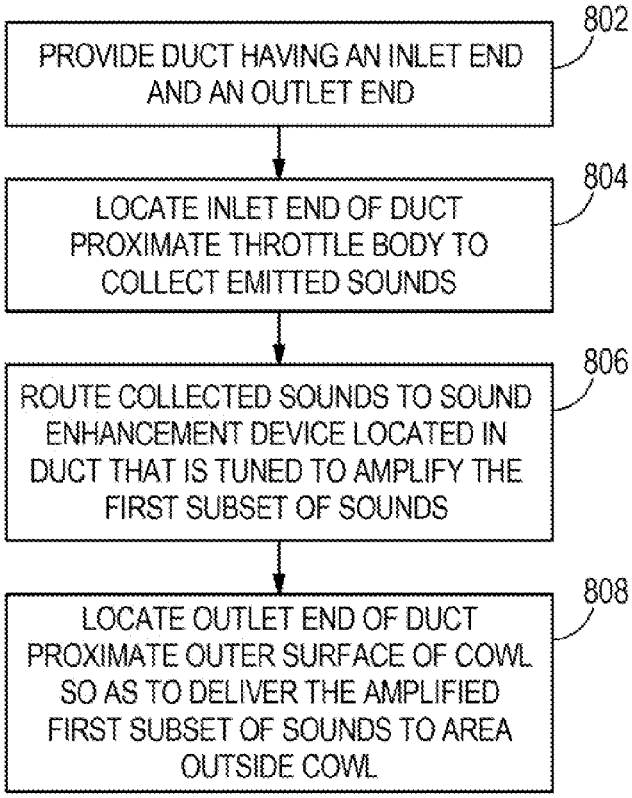
FIG. 8 illustrates a further example of the method for modifying sounds produced by the air intake system.

FIG. 8 shows one particular example of how the method of FIG. 7 may be carried out. As shown at 802, the method may further include providing a duct 24 having an inlet end 26 and an outlet end 28. As shown at 804, the method may include locating the inlet end 26 of the duct 24 proximate the throttle body 16 to collect emitted sounds. As shown at 806, the method may include routing the collected sounds to a sound enhancement device 30 located in the duct 24 that is tuned to amplify the first subset of sounds S1. As shown at 808, the outlet end 28 of the duct 24 may be located proximate an outer surface of the cowl 22, 42 so as to deliver the amplified first subset of sounds S1 to an area outside the cowl 22, 42.

In the above description, certain terms have been used for brevity, clarity, and understanding. No unnecessary limitations are to be inferred therefrom beyond the requirement of the prior art because such terms are used for descriptive purposes and are intended to be broadly construed. The different systems and method steps described herein may be used alone or in combination with other systems and methods. It is to be expected that various equivalents, alternatives and modifications are possible within the scope of the appended claims.

What is claimed is:

1. A method for modifying sounds produced by an air intake system for an internal combustion engine powering an outboard motor, the method comprising:

routing intake air along a flow pathway defined through an air vent in a cowl covering the engine, to an open under-cowl environment surrounding the engine, and to a throttle body of the engine;

collecting sounds emitted in an area of the open under-cowl environment proximate the throttle body of the engine via an inlet end of a sound enhancement duct, wherein the inlet end of the sound enhancement duct is not a part of the flow pathway;

amplifying a first subset of the collected sounds having frequencies within a desired frequency range; and transmitting the amplified first subset of sounds to an area outside the cowl.

2. The method of claim 1, further comprising:

providing the sound enhancement duct with an outlet end;

locating the inlet end of the sound enhancement duct proximate the throttle body so as to collect the emitted sounds;

routing the collected sounds to a sound enhancement device located in the sound enhancement duct that is tuned to amplify the first subset of sounds; and locating the outlet end of the sound enhancement duct proximate an outer surface of the cowl so as to deliver the amplified first subset of sounds to the area outside the cowl.

3. The method of claim 2, wherein the sound enhancement device comprises a flexible membrane extending generally transversely across the sound enhancement duct.

4. The method of claim 3, further comprising sealing the membrane along an inner perimeter of the sound enhancement duct so as to isolate an interior of the sound enhancement duct on a first side of the membrane from airflow in the interior of the sound enhancement duct on a second, opposite side of the membrane.

5. The method of claim 3, further comprising forming the membrane out of rubber.

6. The method of claim 3, further comprising tuning a stiffness of the membrane so as to provide a desired amount of amplification of the first subset of sounds.

7. The method of claim 6, further comprising attenuating a second subset of the collected sounds having frequencies within an undesired frequency range.

8. The method of claim 7, further comprising selecting a shape of the sound enhancement duct so as to provide a desired amount of attenuation of the second subset of sounds.

9. The method of claim 7, further comprising tuning the stiffness of the membrane so as to provide a desired amount of attenuation of the second subset of sounds.

10. The method of claim 7, further comprising providing a sound dampening device within the sound enhancement duct so as to provide a desired amount of attenuation of the second subset of sounds.

11. The method of claim 2, further comprising locating the inlet end of the sound enhancement duct adjacent, but not touching, the throttle body.

12. The method of claim 11, further comprising extending the outlet end of the sound enhancement duct through the outer surface of the cowl.

13. The method of claim 2, wherein the air vent that allows the intake air into the cowl is located aft of the throttle body, and a majority of the sound enhancement duct is located fore of the throttle body.

14. The method of claim 13, wherein the outlet end of the sound enhancement duct is located fore of the throttle body.

15. The method of claim 2, further comprising coupling the sound enhancement duct to an inner surface of the cowl.

16. The method of claim 2, further comprising positioning the inlet end of the sound enhancement duct at a selected distance from the throttle body so as to provide a desired amount of amplification of the first subset of sounds.

17. The method of claim 2, further comprising positioning the sound enhancement device at a selected position within the sound enhancement duct so as to provide a desired amount of amplification of the first subset of sounds.

18. An outboard motor comprising:

an internal combustion engine powering the outboard motor;

a cowl covering the internal combustion engine;

an air vent allowing intake air into the cowl;

a throttle body metering flow of the intake air to the engine;

a sound enhancement duct coupled to an inner surface of the cowl and having an inlet end located adjacent, but not coupled, to the throttle body and an outlet end located proximate an outer surface of the cowl; and a sound enhancement device located within the sound enhancement duct between the inlet end and the outlet end;

wherein the sound enhancement device is tuned to amplify a first subset of sounds collected via the inlet end of the sound enhancement duct, the first subset of sounds having a desired frequency; and wherein the amplified first subset of sounds is transmitted to an area outside the cowl via the outlet end of the sound enhancement duct.

19. The outboard motor of claim 18, wherein the sound enhancement duct is designed to attenuate a second subset of sounds collected via the inlet end of the sound enhancement duct, the second subset of sounds having an undesired frequency.

20. The outboard motor of claim 18, wherein the inlet end of the sound enhancement duct does not touch the throttle body.

* * * * *